United States Patent [19]

Woolard

[11] Patent Number: 4,794,905

[45] Date of Patent: Jan. 3, 1989

[54] MAGNETIC HAND HELD BALL THROWING IMPLEMENT

[76] Inventor: Joseph H. Woolard, 3330 Kellie Ann La., Virginia Beach, Va. 23452

[21] Appl. No.: 52,336

[22] Filed: May 21, 1987

[51] Int. Cl.[4] ..... F41B 3/04; F41F 7/00

[52] U.S. Cl. ..... 124/5; 124/41 B; 446/129

[58] Field of Search ..... 124/5, 41 B, 4; 273/186 A; 446/132, 135, 137, 138, 129

[56] References Cited

U.S. PATENT DOCUMENTS

| | | | |
|---|---|---|---|
| 847,066 | 3/1907 | Hall | 446/137 |
| 1,168,808 | 1/1916 | Von Hoffman | 124/5 |
| 2,135,648 | 11/1938 | Stumpf | 273/186 A |
| 2,705,148 | 3/1955 | Waller | 124/5 |
| 3,137,504 | 5/1962 | Zordar et al. | 373/186 A |
| 3,466,049 | 9/1969 | Fox et al. | 446/138 |
| 3,554,549 | 1/1971 | Grabowski | 446/137 |
| 3,897,068 | 7/1975 | Staples | 273/186 A |
| 4,364,371 | 12/1982 | Woolard | 124/5 |

FOREIGN PATENT DOCUMENTS

| | | | |
|---|---|---|---|
| 665117 | 4/1929 | France | 124/5 |

*Primary Examiner*—Richard C. Pinkham
*Assistant Examiner*—Mark S. Graham
*Attorney, Agent, or Firm*—Pollock, Vande Sande & Priddy

[57] ABSTRACT

An improved ball throwing implement includes a flexible shaft and a retaining means. The retaining means includes a magnetic collar contacting the wall of a diametrical bore provided in a ball or similar game element to be thrown by the implement and a magnetic sleeve insertable into the bore for holding the ball on the shaft. The implement upon application of centrifugal force releases the ball with uniform time of release.

3 Claims, 1 Drawing Sheet

MAGNETIC HAND HELD BALL THROWING IMPLEMENT

TECHNICAL FIELD

The present invention relates to magnetic implements for throwing game elements such as balls. Specifically, the invention concerns a ball throwing implement of the type in which a ball having a diametrical bore is slipped over one end of a ball shaft and thrown by swinging the shaft along an arc until the ball slides off.

BACKGROUND OF THE INVENTION

Ball throwing implements have been known in the art for some time, and are shown, for example, in U.S. Pat. No. 1,168,808 to Von Hoffmann; U.S. Pat. No. 3,897,068 to Staples; and in French patent No. 665,117 to Coutant. While such implements each have their own particular advantages, they all present disadvantages in retaining the ball on the ball shaft while swinging the flexible shaft along an arc until the ball slides off and do not allow uniformity in release time of the ball or other object. Furthermore, they are of complicated structure. U.S. Pat. No. 4,364,371 by the present applicant shows an improved hand held ball throwing implement including a resilient release element and means for adjustment of the force required to throw the ball from the shaft. Depending upon the type of game that is played using the implement and the skill of the user, there has been a need for a ball retainer of the implement to be even more simplified in structure, including less parts than prior art implements, and which would at the same time provide for uniformity of ball release time.

SUMMARY OF THE INVENTION

The object of the present invention is to provide an improved implement for throwing a game element such as a ball which includes a ball retainer of a very simple structure with a minimized number of parts. In the present invention, the springs of the retainer shown in U.S. Pat. No. 4,364,871 can be dispensed with. Instead, a simple magnetic ball retainer is provided.

It is another object of the invention to provide for uniformity of the ball release time required to cause the ball to fly or slide from the implement.

In the preferred embodiment of the invention, the implement comprises an elongated flexible shaft having a grip end and magnetic retaining means including a first and a second magnetic member. The first magnetic member is positioned near the end of the shaft opposite to grip end and contacts the wall of a diametrical bore provided in a game element to be thrown by the implement. The second magnetic member is positioned within the bore and coacts with the first member to hold the ball on the shaft. Upon application of centrifugal force the magnetic throwing implement is adapted to release the ball with uniform time of release.

BEST MODE FOR CARRYING OUT THE INVENTION

Figure 1:
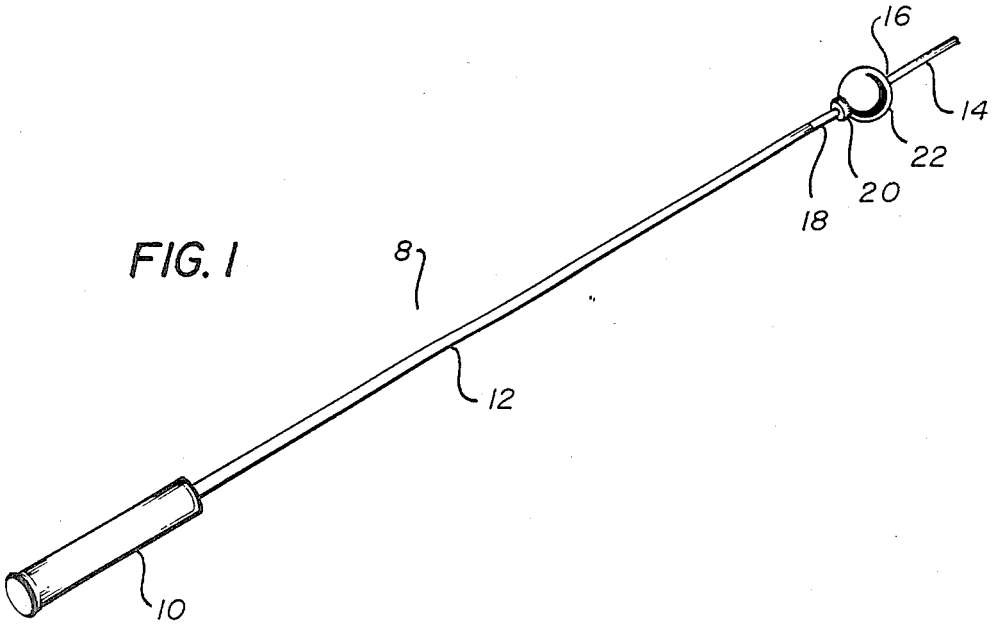
FIG. 1 shows a perspective view of a magnetic ball throwing implement according to the present invention.

The following is a detailed description of a preferred embodiment of the invention, reference being made to the Drawing in which like reference numerals identify like elements of structure in each of the several figures.

Figure 2:
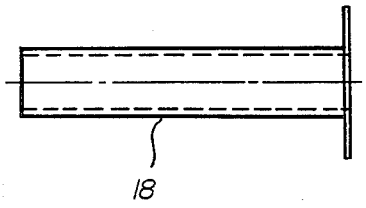
FIG. 2 shows a side view of the flexible shaft and ball coupling sleeve.
Figure 3:
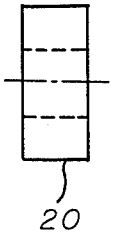
FIG. 3 shows an enlarged side view of the ball retainer magnet.
Figure 4:
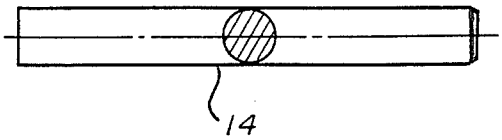
FIG. 4 shows a side view of the ball shaft.
Figure 5:
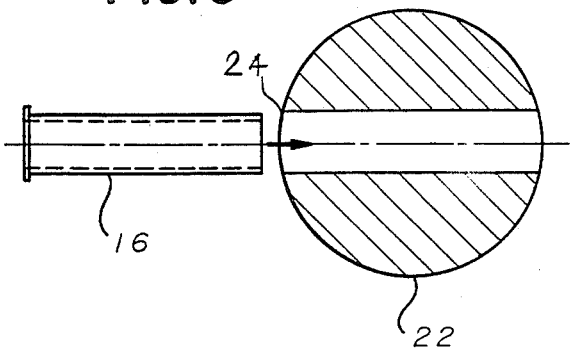
FIG. 5 shows a side view of the ball and the magnetic attractive ball sleeve.

Referring simultaneously to FIGS. 1–5, the structure and function of the magnetic ball throwing implement according to the present invention is explained. The implement 8 comprises a flexible shaft 12 made of a suitable material which is provided at its first end with a hand-grip 10. The hand-grip 10 can be made from any suitable material such as wood, plastic, rubber, etc. At the second, opposite end of the flexible shaft 12, a coupling sleeve 18 is provided for receiving the second end of the flexible shaft and a magnetic attractive ball shaft 14. The coupling sleeve 18 has one end flanged. A ball retaining magnet 20 is attached to the flanged end of the coupling sleeve 18. The ball retaining magnet 20 is adapted to contact the ball at one end of the diametrical bore 24 passing through the ball 22. A magnetic ball sleeve 16 insertable into bore 24 includes a flange for coupling the ball to the retaining magnet 20. In use, the ball 22 is slipped over the end of ball shaft 14 and into contact with ball retainer magnet 20. The user then holds the magnetic ball throwing implement by grip 10 while ball retainer magnet 20 holds ball 22 through ball sleeve 16 to prevent ball 22 from simply dropping from the end of ball shaft 14. By swinging the implement along an arc, the user will eventually bring the implement to a position in which centrifugal force will cause the ball 22 to fly from the implement. Due to the use of the magnetic ball retainer, the present invention implement provides uniformity of the ball release time required to cause the ball to fly from the implement. The present invention is particularly suited for use as a ball throwing implement in a variety of ball games such as golf, target games and the like.

These objects of the invention are given only by way of example; thus, other desirable objectives and advantages inherently achieved by the disclosed structure may occur to those skilled in the art. Nonetheless, the scope of the invention is to be limited only by the appended claims.

What I claim is:

1. A combination ball throwing implement and ball element, wherein said ball-throwing implement comprises:

an elongated flexible shaft having a grip end portion and an opposite end portion;

a sleeve mounted on said opposite end portion;

a magnetic attractive ball shaft secured coaxially to said flexible shaft by said sleeve;

magnetic retaining means including a magnet positioned on said ball shaft at the outer end of said sleeve distal from said opposite end portion; and, said ball element comprises a ball having a diametrical bore and a magnetic member positioned within said bore, said magnetic member adapted to slidably engage said magnetic attractive ball shaft and to coact with said magnetic retaining means to hold said ball on said shaft, said implement upon application of centrifugal force, releasing said ball with a uniform time of release.

2. An implement according to claim 1 wherein said sleeve has a flanged end to which said magnet is attached and said magnetic member includes a magnetic collar contacting said magnet on said flanged end of said sleeve.

3. An implement according to claim 1 wherein said magnetic member positioned within said bore is provided with a flange means one end for coupling with said magnetic retaining means.

* * * * *